US012584367B2

(12) United States Patent
Shamov

(10) Patent No.: US 12,584,367 B2
(45) Date of Patent: Mar. 24, 2026

(54) MULTI-LEVEL SLIP HANGER

(71) Applicant: Baker Hughes Oilfield Operations LLC, Houston, TX (US)

(72) Inventor: Dmitriy Shamov, Dammam (SA)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/509,946

(22) Filed: Nov. 15, 2023

(65) Prior Publication Data

US 2024/0159121 A1 May 16, 2024

Related U.S. Application Data

(60) Provisional application No. 63/383,995, filed on Nov. 16, 2022.

(51) Int. Cl.
*E21B 33/04* (2006.01)

(52) U.S. Cl.
CPC ..... *E21B 33/0422* (2013.01)

(58) Field of Classification Search
CPC ..... E21B 33/0422; E21B 33/04
See application file for complete search history.

(56) References Cited

U.S. PATENT DOCUMENTS 1,654,463 A * 12/1927 Jaques ..... F16L 19/08 285/356
2,920,909 A * 1/1960 Allen ..... E21B 33/0422 285/123.8
2,946,386 A * 7/1960 Jones ..... E21B 33/06 285/123.4
3,011,806 A * 12/1961 Allen ..... F16L 39/005 285/123.8
3,068,027 A * 12/1962 Lewis ..... E21B 33/0422 285/123.8
3,287,035 A * 11/1966 Greenwood ..... E21B 33/0422 285/123.8
3,329,448 A * 7/1967 Allen ..... E21B 33/0422 285/123.5
4,306,742 A * 12/1981 Hardcastle ..... F16L 3/00 285/123.8

(Continued)

FOREIGN PATENT DOCUMENTS

CN 105937382 11/2018
CN 107387016 9/2019

(Continued)

OTHER PUBLICATIONS

D.J. Bazile et al., "New Wellhead Equipment for Old Oilfields," Mar. 15, 1987, SPE/IADC Drilling Conference, New Orleans, Louisiana, 8 pages.

(Continued)

*Primary Examiner* — Kenneth L Thompson
(74) *Attorney, Agent, or Firm* — Hogan Lovells US LLP

(57) ABSTRACT

A casing hanger and seal system for supporting a casing string in a hydrocarbon well. The hanger can have a deformable seal with an ability to transfer force through the seal to a lower portion of the hanger. The hanger can have multiple slips which engage a casing wall and support an upper casing string independent from the deformable seal such that changes in the forces being supported cannot disengage the seal when positioned.

13 Claims, 8 Drawing Sheets

(56) References Cited

U.S. PATENT DOCUMENTS

| | | | | |
|---|---|---|---|---|
| 4,913,469 | A * | 4/1990 | Baugh | E21B 33/0422 285/123.6 |
| 5,031,695 | A | 7/1991 | Cain et al. | |
| 5,421,407 | A | 6/1995 | Thornburrow | |
| 2008/0230229 | A1 | 9/2008 | Shaw et al. | |
| 2016/0040499 | A1 | 2/2016 | Cain et al. | |
| 2021/0396086 | A1 | 12/2021 | Payne | |

FOREIGN PATENT DOCUMENTS

| | | |
|---|---|---|
| CN | 211201849 | 8/2020 |
| WO | 2013/158031 | 10/2013 |

OTHER PUBLICATIONS

International Search Report and Written Opinion issued in PCT Application No. PCT/US2023/080033, mailed Feb. 27, 2024 (9 pages).

* cited by examiner

MULTI-LEVEL SLIP HANGER

CROSS-REFERENCES TO RELATED APPLICATIONS

This application is related to and claims the benefit of priority from U.S. Provisional Application 63/383,995, titled MULTI-LEVEL SLIP HANGER, filed Nov. 16, 2022, the entire disclosure of which is incorporated by reference herein for all intents and purposes.

FIELD OF INVENTION

This invention relates in general to hydrocarbon recovery wells and more particularly to casing support and sealing systems for these wells.

BACKGROUND

In petroleum production, a casing hanger is a portion of a wellhead assembly which provides support for the casing string when it is lowered into the wellbore. It serves to ensure that the casing is properly located and supported within the wellhead. When the casing string has been run into the wellbore it is suspended by a casing hanger, which traditionally rests on a landing shoulder inside the casing spool. Casing hangers are designed to take the full weight of the casing, and provide a seal between the casing hanger and the spool in order to isolate the casing annulus from upper wellhead components. The two primary types of casing hangers are mandrel type hangers and slip type hangers. Slip type casing hangers used to support a casing string by engaging the casing with wedge-type members (slip segments).

This casing hanger system results such that the weight of the casing is kept on the casing hanger for the life of the hanger. This can cause a number of unwanted consequences. In certain instances, the weight loaded onto the hanger may exceed the design of the hanger. Additionally, there can be instances of too little weight being supported by a casing hanger. This can cause improper performance of the seal in these circumstances. Further, the casing weight can change over the course of its use, for example due to thermal expansion. This can reduce the seal pre-loading and result in the loss of sealing at the hanger. Further, these hangers often only have a single sealing location, such that any defect or failure in this sealing location can cause a failure in the seal.

In instances where these casing hangers fail, it can be very costly and time consuming to repair or replace. As a result, it is critical that these hangers are designed to support varying loads while maintaining a constant seal. New and improved designs of casing hangers are therefore required to overcome the deficiencies of traditional systems.

SUMMARY

A first embodiment of the present technology provides for a slip type casing hanger for use in a wellbore. The casing hanger can include an upper set of slips and one or more lower sets of slips. The upper set of slips can be activated by contact with a casing such that the casing load can be transferred to a lower set of slips, deploying the lower slips so they can start engaging with the casing. The load between the slip sets can be transferred using at least one load transfer bolt, which can energize the lower level of slips. Portions of the casing load can be applied to the compressible seal.

The upper slips can be supported out of contact from the adjacent casing by at least one holding screw. The lower slips can be supported out of contact from the adjacent casing by a shear ring.

The compressible seal can be made of an elastomer, metal, flexible graphite, thermoplastic or composite materials.

The compressible seal can be positioned between the upper and lower slips. The load transfer bolt can be positioned to transfer force through the compressible seal. The compressible seal can be in a relaxed state prior to installation.

A second embodiment of the present technology provides for a method of supporting casing in a wellbore. A casing hanger system can be positioned above a casing head and adjacent to a casing. Upper level slip holding bolts can be further removed from the casing hanger. The casing hanger can then be dropped into a bowl and positioned appropriately. A casing string can be lowered down through the hanger allowing upper slips to engage on a casing string above the seal. Further travel down of the casing string can transfer portion of casing weight onto the seal and can shear the shear ring allowing the lower level of slips to engage with the casing string below the seal.

The method can further include sealing a space between the casing and casing hanger. This sealing can occur through the deformation of a compressible seal.

The at least one load transfer bolt can transfer force from the weight of the casing string from the upper slips to the lower slips. This transfer of force can occur through the compressible seal. This can result in the shearing of a shear ring. The shear ring can retain a lower slip from engaging a side of the casing prior to the action of shearing.

A third embodiment of the present technology can provide for a casing system with a casing hanger comprising an upper slip, lower slip, and a compressible seal. The upper and lower slips can be in supporting engagement with the casing string. The compressible seal can be in sealing engagement with the casing. The casing string can be installed into the hanger such that the weight of the casing string can be transferred through the casing hanger at a casing head. The casing string can further be sealed between the casing head by a compressible seal in the casing hanger.

A load transfer bolt can transfer force from the upper to lower slips in the casing hanger. The compressible seal can be compressed to within a pre-determined range for sealing at the casing hanger. The casing hanger can further comprise additional slips which can also be in supporting engagement with the casing. There can be load transfer bolts between the upper slip, lower slip, and at least one additional slip.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
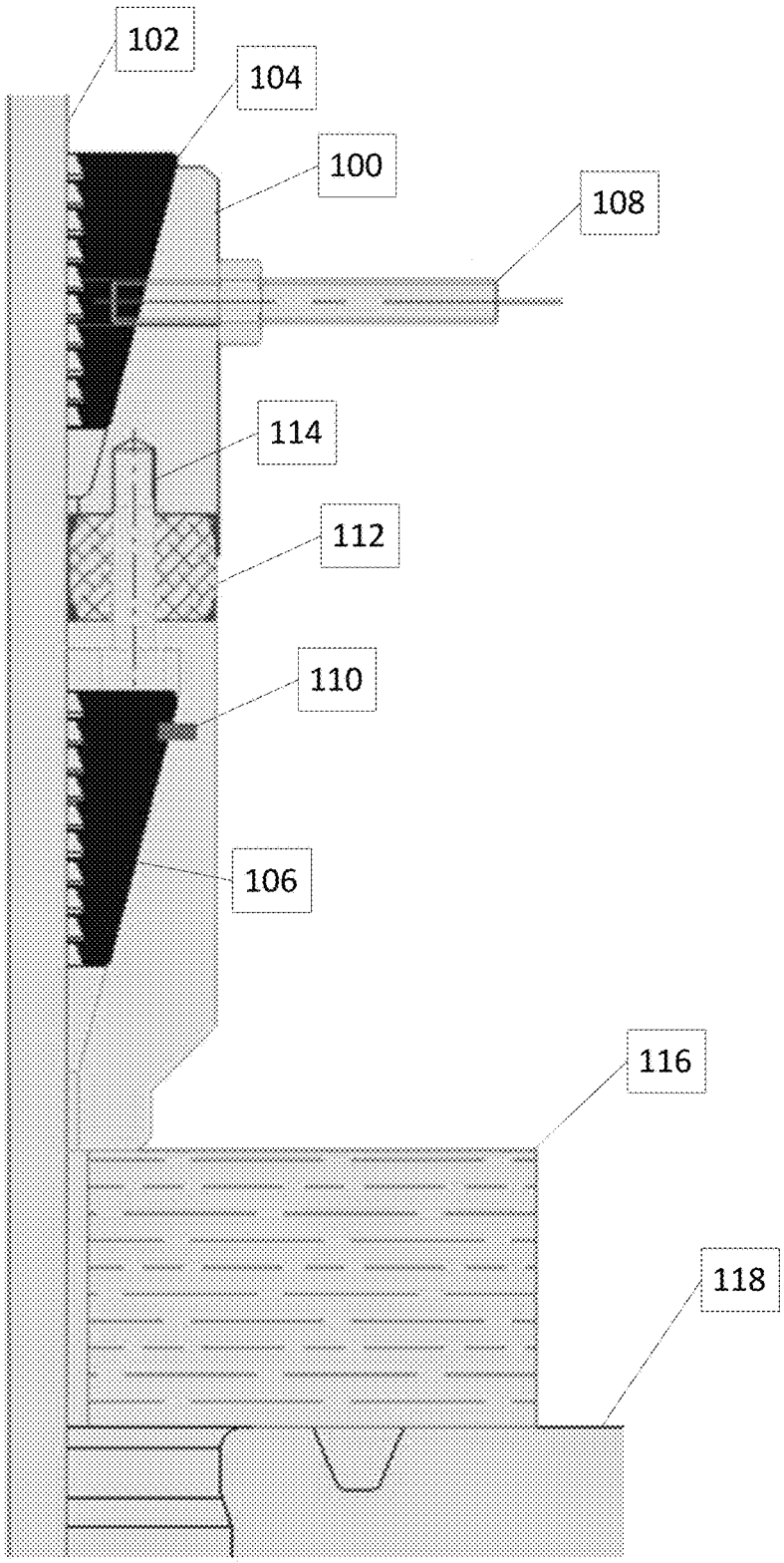
FIG. 1 is a schematic cross-sectional view of an embodiment of the present technology illustrating the casing hanger in a pre-deployment position, with upper slips retained by at least one holding screw and lower slips retained by a shear ring.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The invention, however, is not intended to be limited to the specific terms used, and it is to be understood that each specific term can include equivalents that operate in a similar manner to accomplish a similar purpose.

The present technology provides for a multi-level slip hanger for supporting casing in a well. The hanger can include multiple slips for supporting casing in a well. The slips can be sequentially activated based on the weight of the casing being supported. The hanger can also include a deformable seal for sealing at the hanger.

FIGS. 1-5 provide cutaway cross-sectional views of the slip hanger 100 of the present technology. It is to be understood that the slip hanger 100 provided in the present technology fully surrounds the casing 102 such that support and sealing is provided around the diameter of the casing 102.

FIG. 1 depicts slip hanger assembly 100 prior to being installed within an annular space. The slip hanger 100 can have upper slips 104 and lower slips 106. Before being inserted, the slips can be held away from contact with the casing 102. For the upper slips 104, at least one holding screw 108 can prevent movement. A holding screw 108 can be provided for each segment of the upper slips 104 around the slip hanger 100. For the lower slips 106, a shear ring 110 can prevent movement.

The slip hanger 100 can also include a compressible seal 112. The seal can be made of an elastomer, metal, flexible graphite, thermoplastic, composite materials, or any other appropriate material. Between the upper and lower portions of the slip hanger 100, there can be at least one load transfer bolt 114. The at least one load transfer bolts 114 can transfer forces associated with supporting the casing strings from the upper portion of the hanger 100 above the at least one load transfer bolts 114 to the lower portion of the hanger 100 below the at least one load transfer bolts 114. There can be at least one load transfer bolt 114 associated with each segment of the upper slips 104 and lower slips 106 in some embodiments.

In the embodiment of FIG. 1, the slips on both levels of the hanger 100 have not yet been positioned in proximity to the casing string 102 that is to be supported and sealed. In the figure, at least one support block 116 can support the hanger 100 above the casing spool 118. In this state, the hanger 100 (including the slips 104 and 106 and seal 112) can be in relaxed positions.

Figure 2:
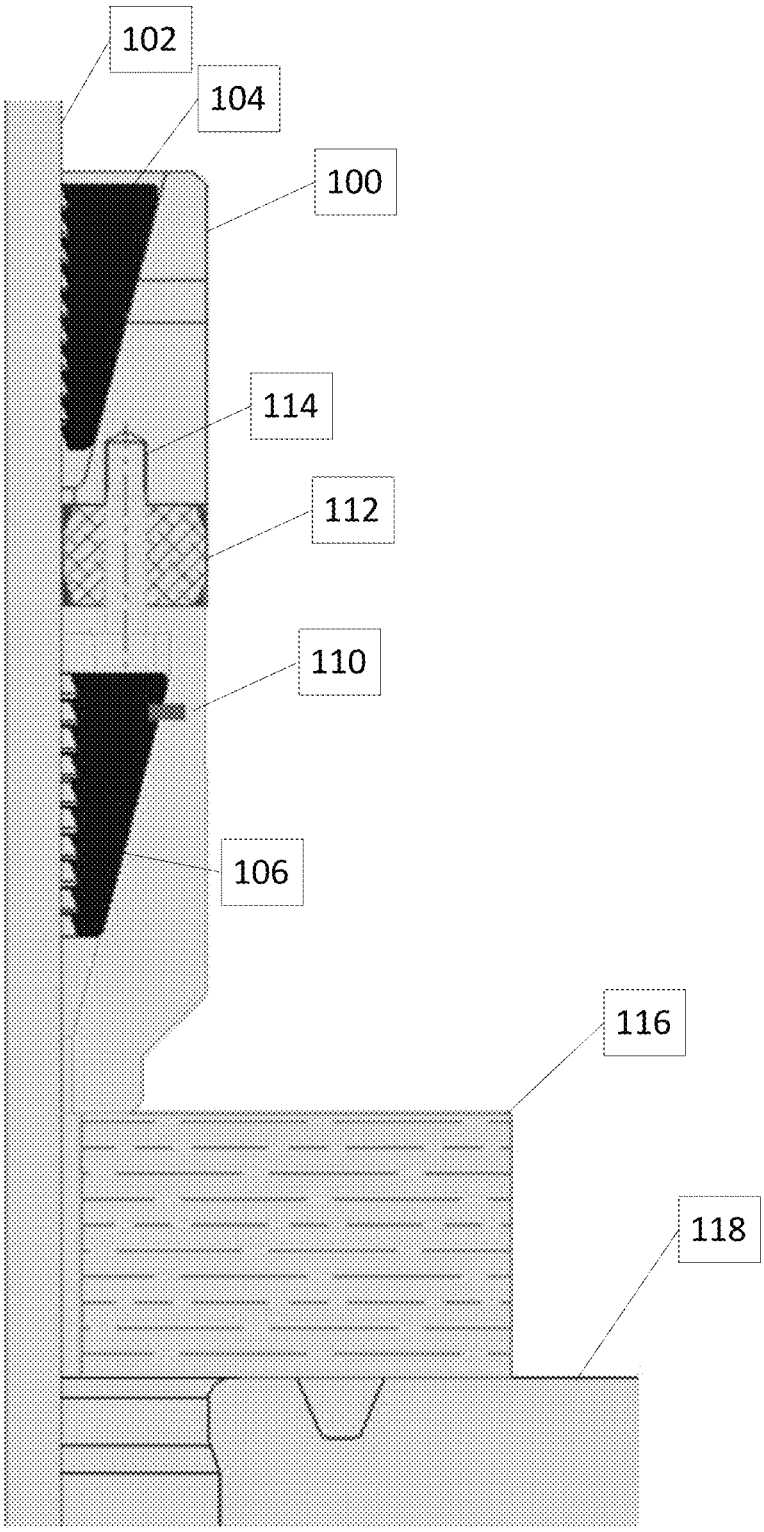
FIG. 2 is a schematic cross-sectional view of an embodiment of the present technology with all holding screws removed from the hanger and the upper slips in contact with the casing string.

FIG. 2 provides an embodiment of the hanger after the at least one holding screw 108 has been removed. In this embodiment, the upper slips 104 can move and contact the casing 102. However, the upper slips 104 may not be engaged with the casing 102 at this time. At this time, the slip hanger 100 is not providing support to the casing 102.

Conversely, the lower slips 106 can still be held away from the casing 102 by the sheer ring 110. As such, the lower slips 106 may not be able to contact the casing 102 at this time. The seal 112 can remain in a relaxed state at this time.

Figure 3:
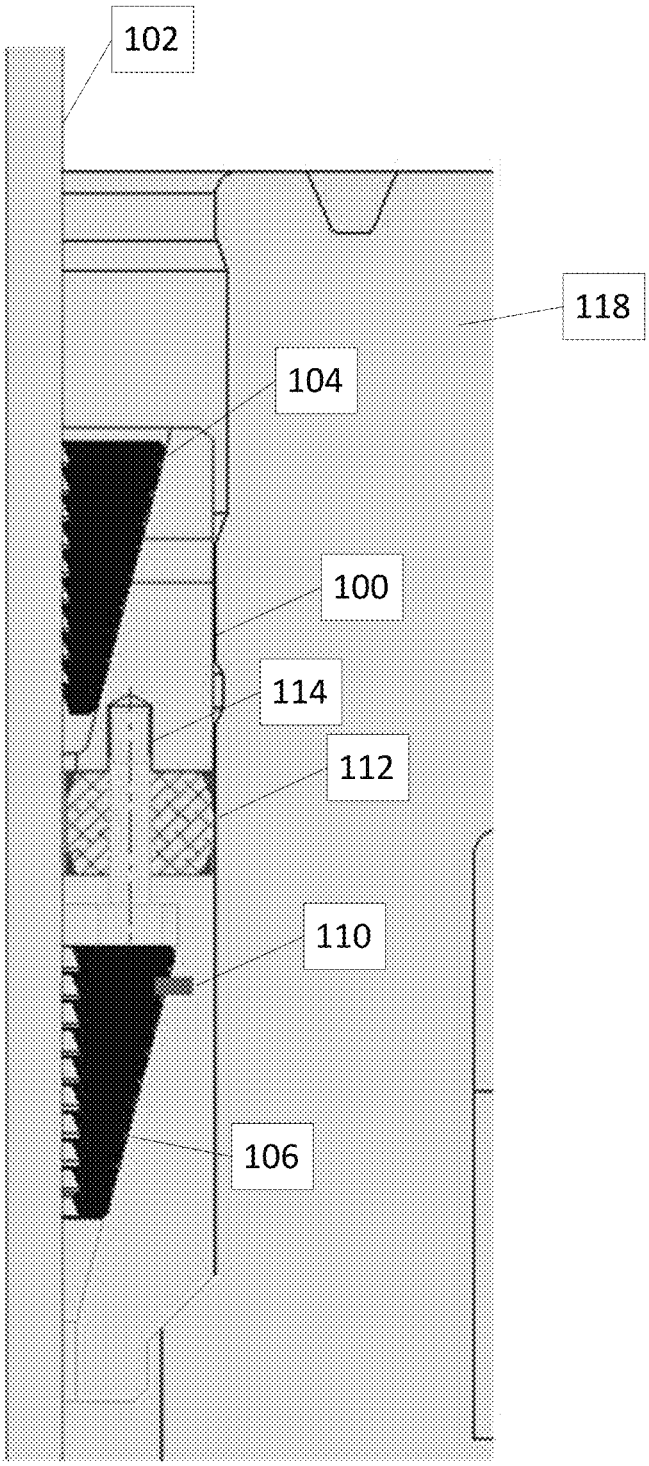
FIG. 3 is a schematic cross-sectional view of an embodiment of the present technology with the hanger system dropped into a bowl of the casing head and in contact with the casing string.

FIG. 3 depicts an embodiment where the hanger 100 of the present technology has been dropped into the bowl after removal of the block 116. The upper slips 104 can start engaging with the casing when the casing 102 is lowered through the hanger 100. At this time, the hanger 100 has begun to engage with the casing 102 at the upper slips 104 but is still providing minimal support to the casing 102.

Figure 4:
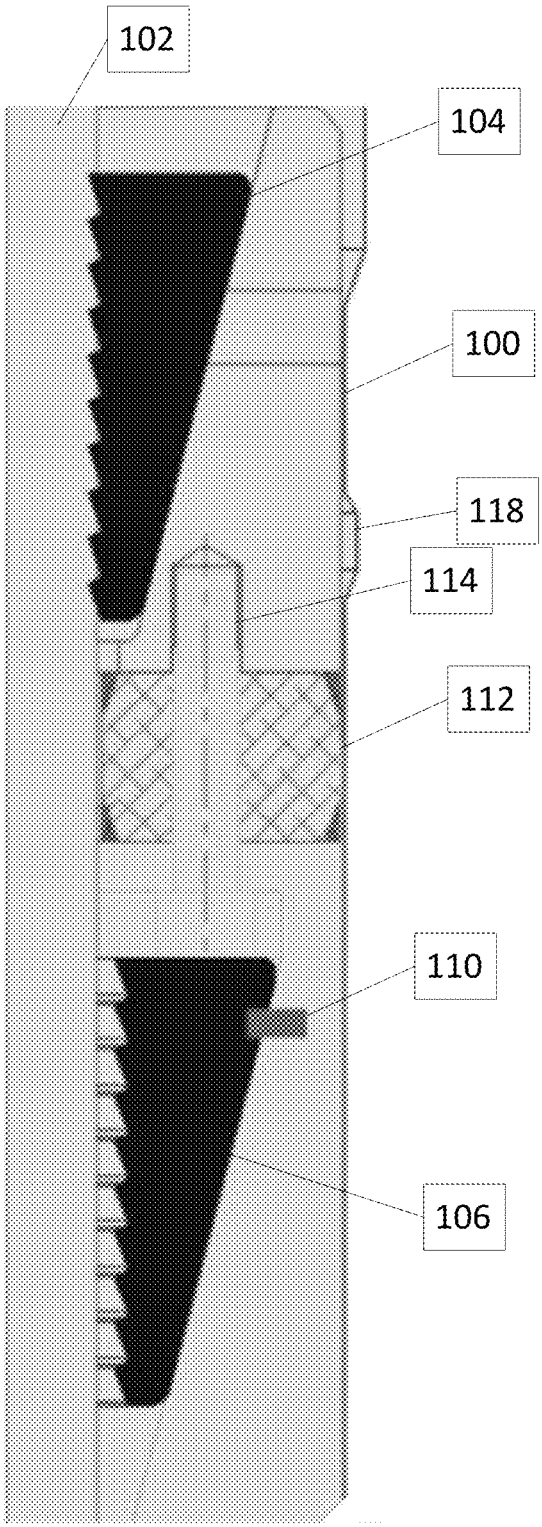
FIG. 4 is a schematic cross-sectional view of an embodiment of the present technology illustrating further movement with upper slips engaging the casing under load, before the load causes shearing of the shear ring.

FIG. 4 depicts an embodiment of the hanger 100 after the casing string 102 has engaged with upper slips 104 and has started exerting force on upper portion of the hanger 100. The initial portion of the weight from the casing at this stage is loaded through the upper slips 104 and into the hanger 100 including the lower slips 106 and shear ring 110 through the at least one load transfer bolt 114.

In the current embodiment, the load being transferred by the at least one load transfer bolt 114 may not be sufficient to break the sheer ring 110. As such, the lower slips 106 can still be held away from the casing 102 at this time. Further, the seal 112 can remain in a relaxed state at this time.

Figure 5:
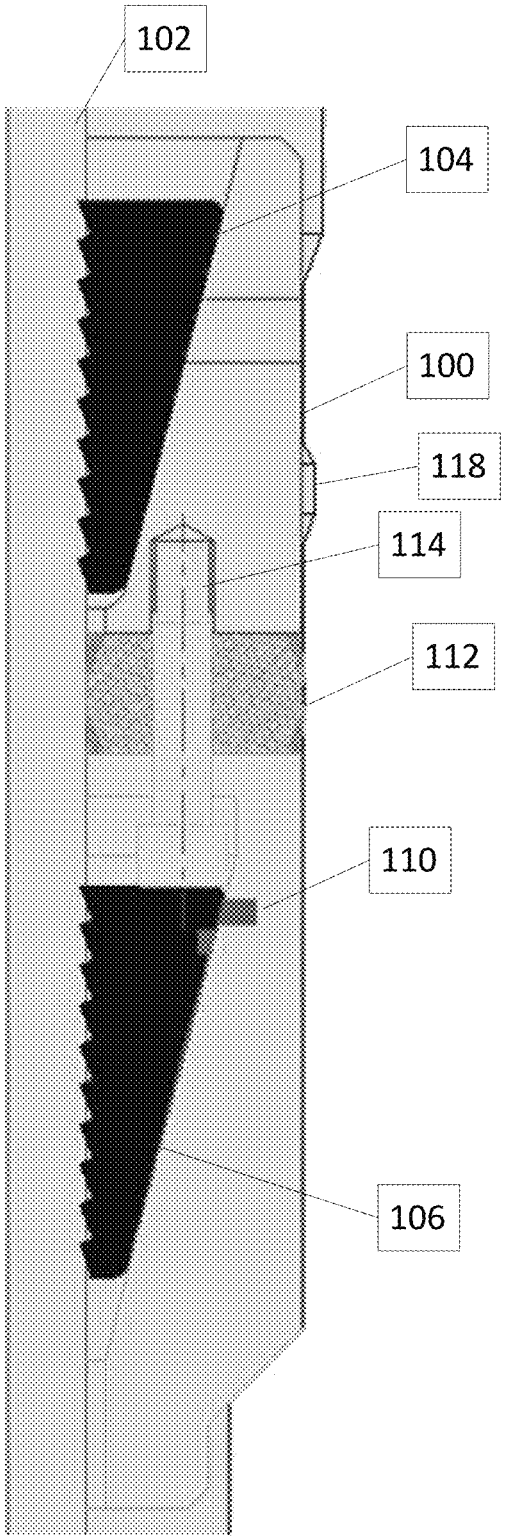
FIG. 5 is a schematic cross-sectional view of an embodiment of the present technology with fully engaged slips on both levels and an energized seal.

FIG. 5 is an embodiment of the hanger 100 in a final position after the full weight from the casing string 102 has been transferred to the hanger 100. The casing is supported on two levels, by upper and lower slips 104 and 106. Here, the force from the weight of the casing string 102 can be transferred through the at least one load transfer bolt 114 sufficient to shear the sheer ring 110. When this happens, the lower slips 106 can contact and engage with the casing, providing additional support to the upper slips 104.

Additionally, the seal 112 of the hanger 100 can compress to within a pre-determined range. This can result such that the seal fills the gap between the casing string 102 and the wellhead bowl. The seal can further include anti-extrusion features to control the expansion of the seal. This can allow sealing of the system independent of the actual casing weight being supported by the hanger 100. This can be performed by decreasing the distance between the upper slips 104 and lower slips 106 by a predetermined distance resulting in a predetermined change in the seal geometry. This can result in sealing of the space regardless of if the hanger 100 is overloaded or underloaded.

In some embodiments of the present technology there can be additional groups of slips and seals as required. The multiple groups of slips can create a load distribution system capable of accommodating various casing weights and pressure loads from either side without disturbing the seals. This is due to the fact that the casing weight can be supported by the slips and may not be loaded on the seal after the slips are engaged. Additional casing weight can be transferred through any additional load distribution bolts within the system and to additional lower slips as they are provided.

Figure 6A:
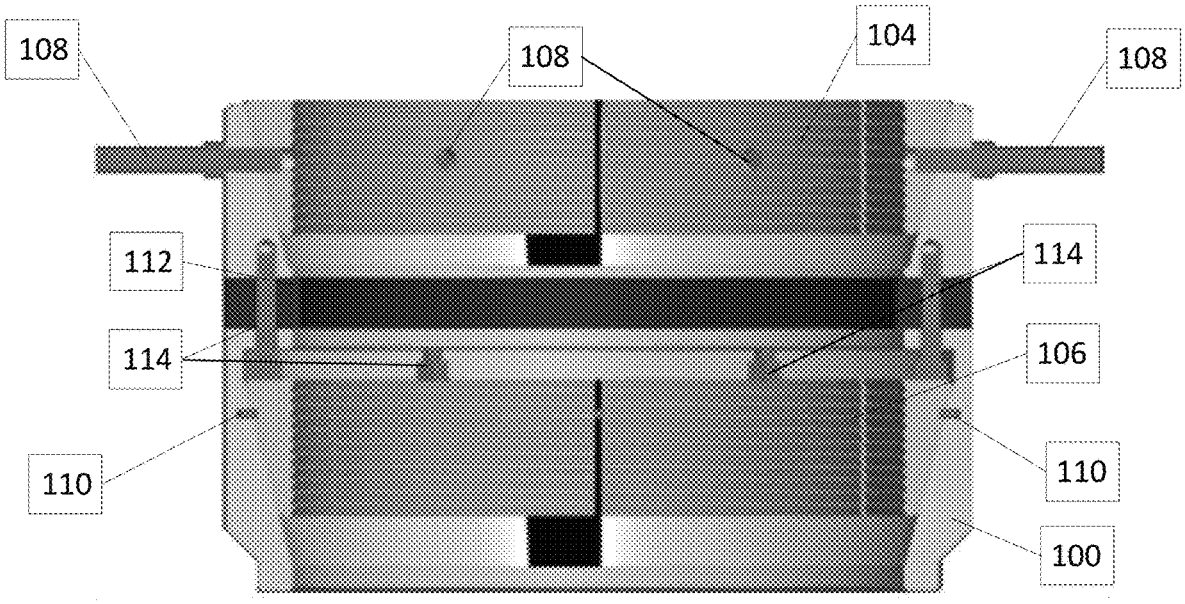
FIG. 6A is a three-dimensional cross-sectional view of an embodiment of the present technology.
Figure 6B:
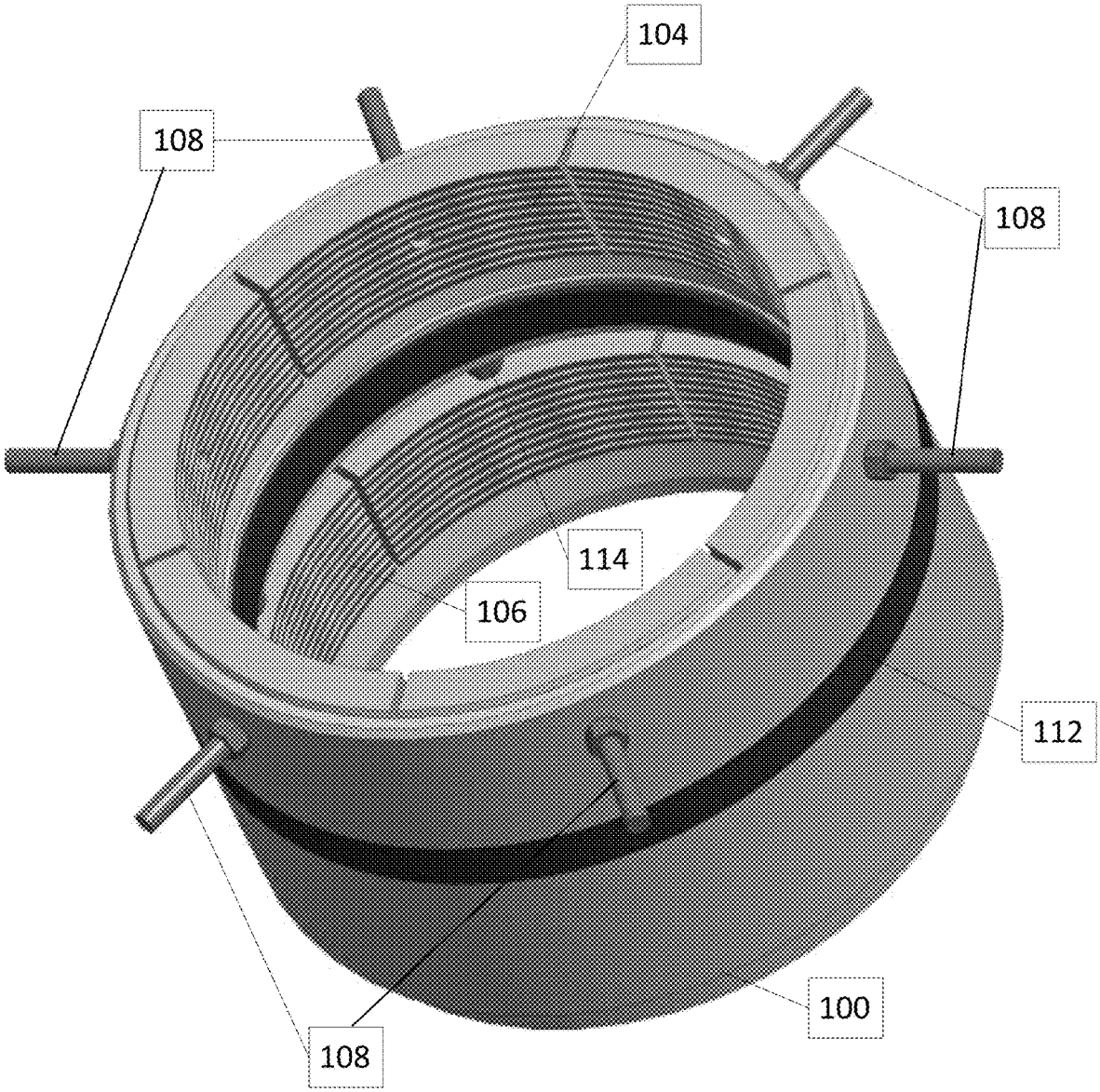
FIG. 6B is a three-dimensional isometric view of an embodiment of the present technology.

FIGS. 6A and 6B provide for a three-dimensional view of the technology. FIG. 6A provides the various segments of the upper slips 104 and lower slips 106 with holding screws 108 positioned to support the segments of the upper slips 104 from contacting the casing. FIG. 6A further provides the positioning of the load transfer bolts 114 throughout the hanger 100 for load transfer from the upper slips 104 to lower slips 106.

FIG. 6B provides a three-dimensional isometric view of the current technology with six different segments of upper slips 104 and lower slips 106. As a result, six different holding screws 108 are provided for the various slip segments. The seal 112 is also clearly shown around the circumference of the hanger 100 for sealing the casing string.

Figure 7:
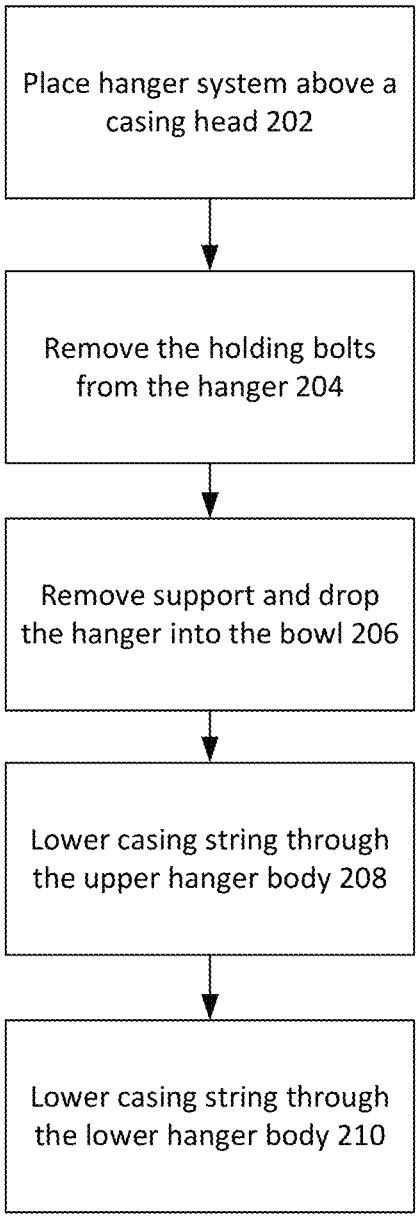
FIG. 7 is a method of sealing a space and supporting a casing string with the casing hanger system of the present technology.

FIG. 7 provides a method of engaging the hanger seal of the present invention. A hanger system can be first positioned above a casing head in step 202. Appropriate holding bolts can be removed in 204, allowing slips being held by the holding bolts to contact the casing. The supports can be removed, and the hanger can be allowed to be positioned into the bowl at step 206. The casing string can be initially lowered into the hanger seal in step 208. This can result in engagement between the hanger seal and the upper slips at this time. In step 210, the casing string can continue to be lowered through the hanger. This can result such that the seal can energize, and the lower slips can be engaged due to the shearing of the sheer ring. After this step, the hanger can be engaged at both the upper and lower slips to provide support and the seal can provide sealing engagement with the casing.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A casing hanger system comprising:

a casing hanger comprising:

upper slips supported out of contact from a casing when in a pre-deployed condition, and in supporting engagement with a casing string when in a deployed condition;

lower slips supported out of contact from the casing when in a pre-deployed condition, and in supporting engagement with a casing string when in a deployed condition;

at least one load transfer bolt connecting the upper slips to the lower slips; and a compressible seal positioned between the upper slips and the lower slips;

wherein a support for the upper slips and a support of the lower slips is selected from the group consisting of at least one holding screw and a shear ring.

2. The casing hanger system of claim 1, wherein a support for the upper slips is at least one holding screw.

3. The casing hanger system of claim 1, wherein a support for the lower slips is a shear ring.

4. The casing hanger system of claim 1, wherein the compressible seal comprises a material selected from the group consisting of an elastomer, a metal, flexible graphite, thermoplastic, or composite materials.

5. The casing hanger system of claim 1, wherein the at least one load transfer bolt is positioned to transfer force through the compressible seal.

6. The casing hanger system of claim 1, wherein the compressible seal is in an uncompressed state when the upper slips and the lower slips are in a pre-deployed condition.

7. The casing hanger system of claim 1, wherein the compressible seal is in a compressed state when the upper slips and the lower slips are in a deployed condition.

8. The casing hanger system of claim 1, wherein the at least one load transfer bolt is used to transfer force from the upper slips to the lower slips of the casing hanger.

9. The casing hanger system of claim 1, further comprising a casing string installed in the casing hanger, the casing string comprising:

a casing weight transferred to a casing head through the casing hanger, the casing string sealed between the casing head and the casing hanger by the compressible seal.

10. The casing hanger system of claim 9, wherein the compressible seal is compressed to within a pre-determined range for sealing the casing hanger.

11. The casing hanger system of claim 9, wherein the casing hanger further comprises at least one additional slip in supporting engagement with the casing.

12. The casing hanger system of claim 9, wherein the casing weight is loaded on both the upper slips and the lower slips of the casing hanger.

13. The casing hanger system of claim 12, wherein the at least one load transfer bolt is used to transfer force from the upper slips to the lower slips of the casing hanger.

* * * * *